US012774817B2

(12) United States Patent
Blumenthal et al.

(10) Patent No.: US 12,774,817 B2
(45) Date of Patent: Oct. 27, 2026

(54) NOZZLE APPARATUS FOR A COOKING APPLIANCE

(71) Applicant: WHIRLPOOL CORPORATION, Benton Harbor, MI (US)

(72) Inventors: Lisa E. Blumenthal, St. Joseph, MI (US); Davide Bottalico, Fabriano (IT); Trevor T. Carlson, Holland, MI (US); Nicholas E. Crow, St. Joseph, MI (US); Kevin Dolezan, Stevensville, MI (US); Ankur Garg, Pune (IN); Hemlata P. Khanvilkar, Pune (IN); Nicholas J. Kormanik, St. Joseph, MI (US); Ajit Maruti Patil, Pune (IN); Timothy Patrick VanAntwerp, St. Joseph, MI (US); Dustin M. Walter, Kalamazoo, MI (US); Akhil Haribhau Wankhede, Chandrapur (IN)

(73) Assignee: Whirlpool Corporation, Benton Harbor, MI (US)

( * ) Notice: Subject to any disclaimer, the term of this patent is extended or adjusted under 35 U.S.C. 154(b) by 734 days.

(21) Appl. No.: 17/941,630

(22) Filed: Sep. 9, 2022

(65) Prior Publication Data

US 2024/0085028 A1 Mar. 14, 2024

(51) Int. Cl.
*F24C 15/20* (2006.01)

(52) U.S. Cl.
CPC ..... *F24C 15/2007* (2013.01)

(58) Field of Classification Search
CPC .. F24C 15/2007; F24C 15/001; F24C 15/002; F24C 15/101; F24C 15/105; F24C 15/2035; F24C 15/2042; F24C 15/32; F24C 15/36
USPC ..... 126/21
See application file for complete search history.

(56) References Cited

U.S. PATENT DOCUMENTS 2,290,360 A * 7/1942 Rose ..... F24C 15/001 126/303
2,329,853 A * 9/1943 Ring ..... F24C 15/001 126/299 R
2,396,122 A * 3/1946 Pellegrin ..... F24C 15/32 126/21 R (Continued)

FOREIGN PATENT DOCUMENTS

DE 88023657 U1 4/1988
EP 0132364 A2 1/1985

(Continued)

*Primary Examiner* — Vivek K Shirsat
(74) *Attorney, Agent, or Firm* — Price Heneveld LLP

(57) ABSTRACT

A cooking appliance comprises an outer frame surface defining a cooktop and the cooktop defines an outlet port. An inner frame surface defines a heating cavity disposed below the cooktop and within the outer frame surface. The inner frame surface defines an inlet port and a chimney extends between a first end connected to the inlet port and a second end connected to the outlet port for directing steam from the heating cavity outside of the cooking appliance. A nozzle apparatus is connected around the outlet port and includes an inner wall defining at least one aperture. The at least one aperture is oriented at an acute angle relative to the cooktop. The nozzle apparatus includes at least one post for connection to the cooktop.

19 Claims, 17 Drawing Sheets

(56) References Cited

U.S. PATENT DOCUMENTS 3,551,963 A * 1/1971 Mosher, Jr. et al. ..... A44B 17/0029 411/512
3,624,742 A * 11/1971 Hurko ..... F24C 15/2007 126/41 R
3,832,988 A * 9/1974 Doner ..... F24C 15/2007 126/39 J
4,019,010 A * 4/1977 Tanaka ..... H05B 6/705 219/746
4,021,642 A * 5/1977 Fields, Jr. ..... F24C 15/2007 219/400
4,951,646 A 8/1990 Diekmann et al.
5,158,065 A 10/1992 Lee et al.
6,761,159 B1 7/2004 Barnes et al.
7,923,663 B2 4/2011 Kim et al.
9,021,942 B2 5/2015 Lee et al.
10,288,298 B2 5/2019 Chadwick et al.
10,443,858 B2 10/2019 Stokes et al.
2004/0177841 A1* 9/2004 Little ..... F24C 3/085 126/39 R
2010/0163549 A1* 7/2010 Gagas ..... F24C 15/2042 219/622
2012/0272946 A1 11/2012 Phillips et al.
2018/0003389 A1* 1/2018 Trice ..... F24C 15/32
2018/0245797 A1* 8/2018 Johnson ..... F24C 15/006
2018/0245799 A1 8/2018 Billman et al.
2022/0082266 A1 3/2022 Perugu et al.
2022/0221158 A1* 7/2022 Jang ..... F24C 15/006

FOREIGN PATENT DOCUMENTS

EP 2444738 B1 2/2020
EP 3015773 B1 11/2021
GB 1238465 A 7/1971
GB 2163547 A 2/1986
JP H0914663 A 1/1997
WO WO-2011076657 A2 * 6/2011 ..... F24C 15/32

* cited by examiner

NOZZLE APPARATUS FOR A COOKING APPLIANCE

BACKGROUND OF THE DISCLOSURE

The present disclosure generally relates to a nozzle apparatus and, more specifically, to a nozzle apparatus that directs steam relative to a cooking appliance.

BACKGROUND

Cooking appliances, particularly stoves with internal heating cavities generate steam while cooking foodstuff. The generated steam can adversely impact cooking performance and operational life of the cooking appliance. As such, many modern cooking appliances are provided with a steam outlet that routes steam towards an outer surface of the cooking appliance. While these traditional steam outlets reduce the overall adverse impacts of steam, they still tend to route steam towards portions of the cooking appliance or surrounding kitchen surfaces. When steam contacts a surface of the cooking appliance or surrounding kitchen, the steam condensates and generates a significant amount of fluid that can result in adverse impacts to the cooking appliance.

Accordingly, the present disclosure relates to a nozzle apparatus that directs steam relative to a cooking appliance to provide a reduction in condensation.

SUMMARY OF THE DISCLOSURE

According to one aspect of the present disclosure, a cooking appliance is provided. The cooking appliance comprises an outer frame surface defining a cooktop and the cooktop defines an outlet port. An inner frame surface defines a heating cavity disposed below the cooktop and within the outer frame surface. The inner frame surface defines an inlet port and a chimney extends between a first end connected to the inlet port and a second end connected to the outlet port for directing steam from the heating cavity outside of the cooking appliance. A nozzle apparatus is connected around the outlet port and includes an inner wall defining at least one aperture. The at least one aperture is oriented at an acute angle relative to the cooktop.

According to another aspect of the present disclosure, an electric cooking appliance is provided. The electric cooking appliance comprises an outer frame surface defining a cooktop and the cooktop defines an outlet port. An inner frame surface defines a heating cavity disposed below the cooktop and within the outer frame surface. The inner frame surface defines an inlet port and a chimney extends between a first end connected to the inlet port and a second end connected to the outlet port for directing steam from the heating cavity outside of the cooking appliance. A cover includes a closed position wherein the cover substantially overlaps the cooktop, and an open position wherein the cover is pivoted at an angle from the cooktop. A nozzle apparatus is connected to the outlet port via a snap-fit connection and includes an inner wall defining at least one aperture. The at least one aperture is oriented at an angle substantially centrally between the cooktop and the cover in the open position.

According to yet another aspect of the present disclosure, a gas cooking appliance is provided. The gas cooking appliance comprises an outer frame surface defining a cooktop and the cooktop defines an outlet port. An inner frame surface defines a heating cavity disposed below the cooktop and within the outer frame surface. The inner frame surface defines an inlet port and a chimney extends between a first end connected to the inlet port and a second end connected to the outlet port for directing steam from the heating cavity outside of the cooking appliance. A rear console includes internal electric components and extends at an angle from the cooktop. A nozzle apparatus is connected around the outlet port and includes an inner wall defining at least one aperture. The at least one aperture is oriented at an angle substantially centrally between the cooktop and the rear console.

These and other features, advantages, and objects of the present disclosure will be further understood and appreciated by those skilled in the art by reference to the following specification, claims, and appended drawings.

Figure 1:
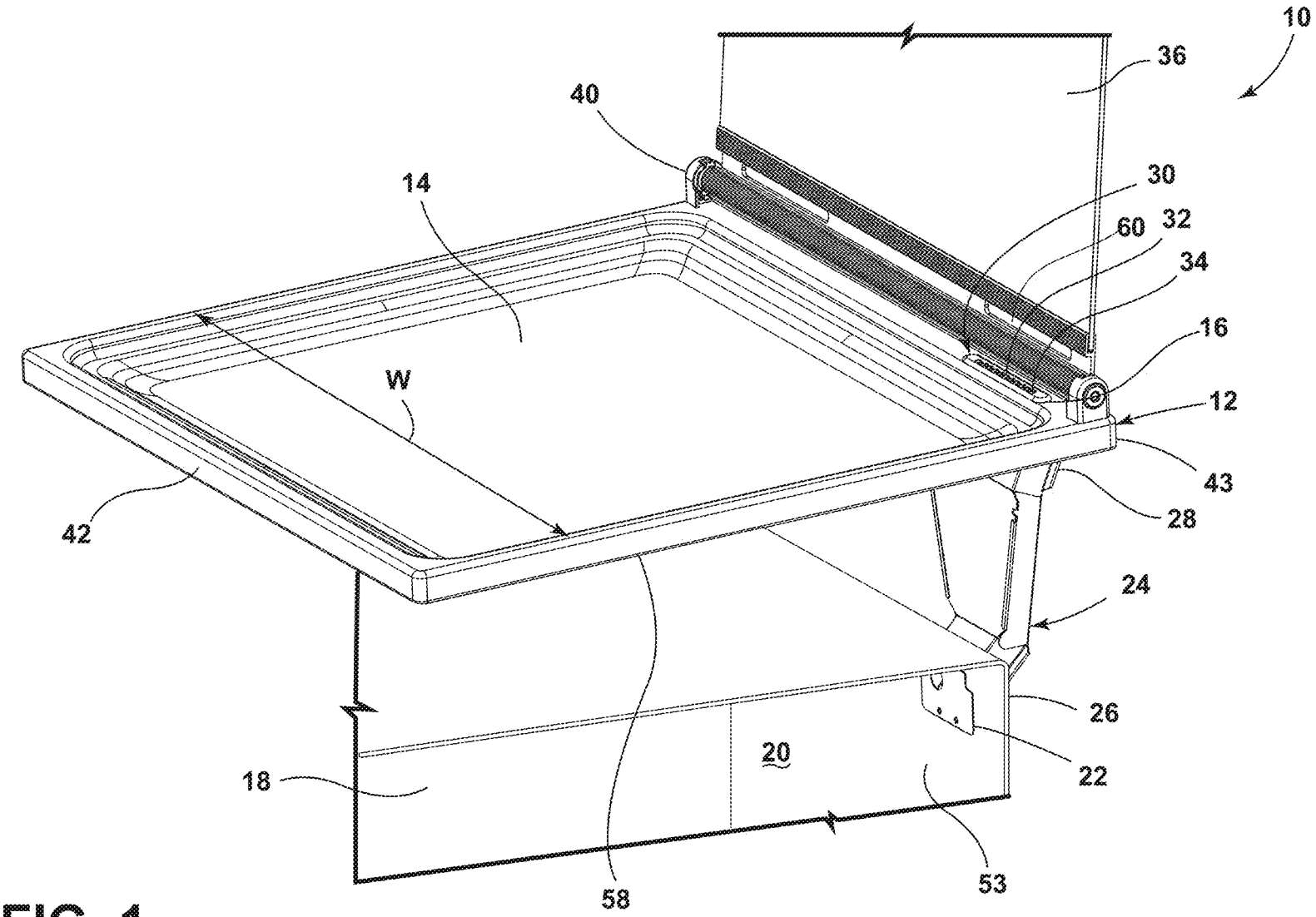
FIG. 1 is a top perspective view of a first embodiment of a cooking appliance with a nozzle apparatus according to an aspect of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a nozzle apparatus that directs steam relative to a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIG. 1, reference numeral 10 generally designates a cooking appliance according to a first embodiment. The cooking appliance 10 may be configured to be heated with electricity. The cooking appliance 10 includes an outer frame surface 12 defining a cooktop 14. The cooktop 14 may include one or more burning elements and an outlet port 16. An inner frame surface 18 defines a heating cavity 20 disposed below the cooktop 14 and within the outer frame surface 12. The inner frame surface 18 defines an inlet port 22. A chimney 24 extends between a first end 26 connected to the inlet port 22 and a second end 28 connected to the outlet port 16 for directing steam from the heating cavity 20 outside of the cooking appliance 10. A nozzle apparatus 30 is located at least partially in or adjacent to the outlet port 16. The nozzle apparatus 30 includes an inner wall 32 defining at least one aperture 34 (e.g. one, two, three, four, five, six, seven, eight, nine, ten, or more). The at least one aperture 34 may be oriented at an acute angle relative to the cooktop 14 and a transverse angle relative to the outlet port 16.

The cooking appliance 10 further includes a cover 36 having a closed position (not shown) wherein the cover 36 substantially overlaps the cooktop 14, and an open position (FIG. 1) wherein the cover 36 is pivoted at an angle from cooktop 14. The angle of the cover 36 in the open position is greater than the angle of the at least one aperture 34. In other words, steam routed through the at least one aperture 34 is directed at an angle between the cooktop 14 and the cover 36 in the open position. The aperture 34 may be oriented at an angle less than 90° from the cooktop 14, for example, less than 80°, less than 70°, less than 60°, less than 50°, less than 40°, less than 30°, less than 20°, between 30° and 60°, between 35° and 55°, or about 45°. The cover 36, on the other hand, may open at an angle more than 80° from the cooktop 14, for example, more than 90°, more than 95°, between 90° and 100°, or about 95°. The cover 36 may connect to the cooktop 14 via a hinge 40. In the closed position, the cover 36 may be at an angle less than 10°, for example, less than 5°, or about 0°. The cooktop 14 extends between a front edge 42 and a rear edge 43. The outlet port 16 may be located near the rear edge 43 and the nozzle apparatus 30 is configured to direct steam towards the front edge 42. The hinge 40 may likewise connect the cover 36 near the rear edge 43 such that it becomes substantially aligned with the rear edge 43 in the open position.

Figure 2:
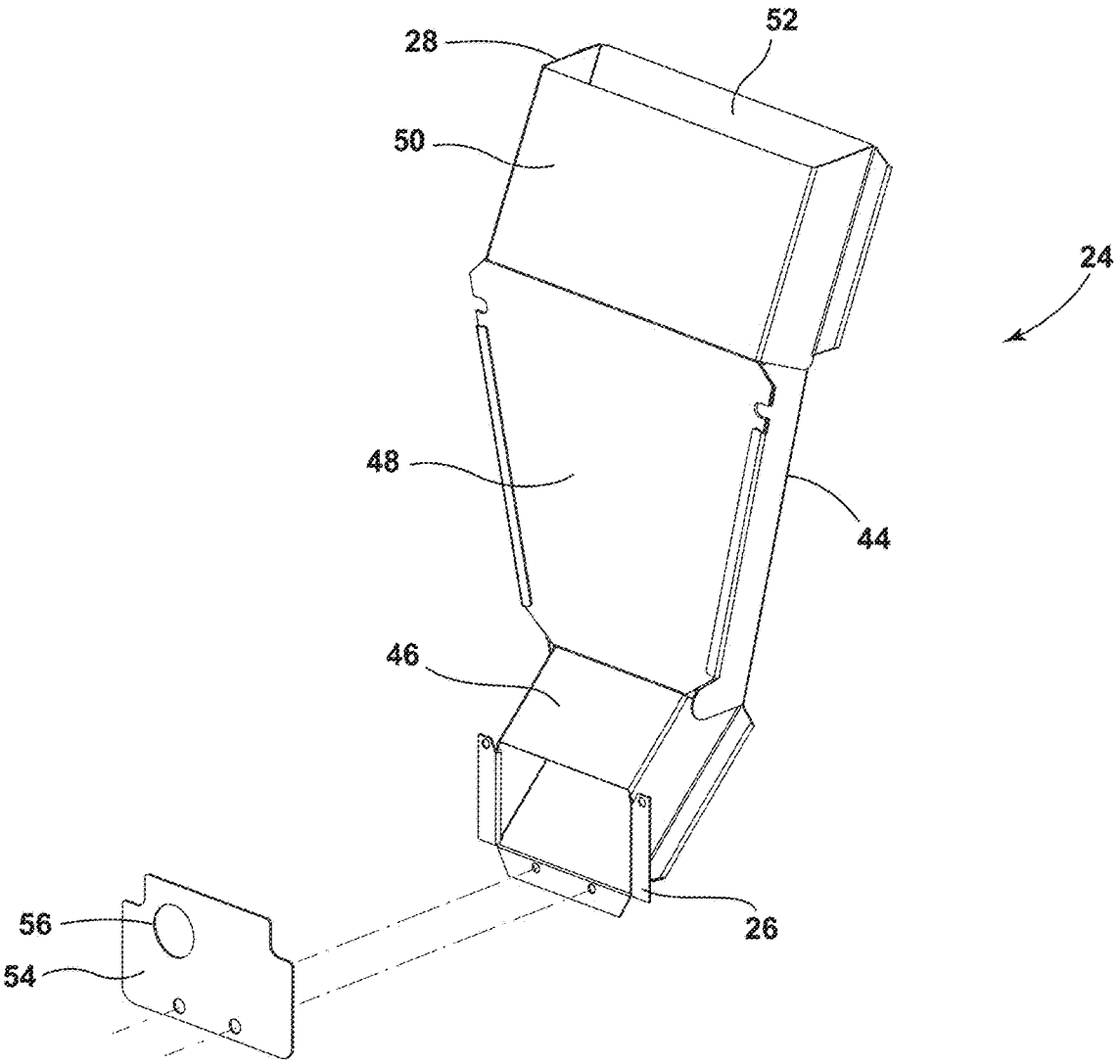
FIG. 2 is a top perspective view of a chimney of the cooking appliance according to an aspect of the present disclosure.

FIG. 2 is a top perspective view of the chimney 24, wherein the chimney 24 is isolated from the cooking appliance 10. The chimney 24 includes a chimney body 44 extending between the first end 26 and a second end 28. The chimney body 44 includes a first section 46 that extends from first end 26 to a second section 48. The second section 48 extends from the first section 46 to a third section 50 that terminates at the second end 28. The inlet port 22 may be located on a rear wall 53 (FIG. 1) of the inner frame surface 18, such that steam is routed at least partially horizontally through the inlet port 22. The first section 46 may extend at a first upward angle relative to the inlet port 22 and the second section 48 may extend at a second upward angle relative to the inlet port 22. In some embodiments, the first upward angle is less than the second upward angle. The third section 50 may extend at a third upward angle that is also less than the second upward angle. In other words, the second section 48 may be oriented in a direction that is substantially vertical whereas the first section 46 and the third section 50 may be oriented in a substantially non-vertical direction. The chimney body 44 defines a chimney chamber 52 extending between the first end 26 and the second end 28. From the first end 26, the first section 46 may taper outwardly such that a cross-section of the chimney chamber 52 gets progressively bigger towards the second section 48. The second section 48 may extend from the first section 46 and also taper outwardly such that the cross-section of the chimney chamber 52 gets progressively bigger towards the third section 50. In other words, the chimney body 44 includes at least one section 46, 48 that tapers outwardly along a width "W" (FIG. 1) of the cooktop 14 such that the cross-section of the chimney chamber 52 gets progressively bigger in a direction from the first end 26 towards the second end 28. As such, the second end 28 may be wider along the width of the cooktop 14 than the first end 26.

With continued reference to FIG. 2, the chimney chamber 52 at the first end 26 may be semi-closed. For example, the first end 26 may be connected, integrally or otherwise, to a restrictor plate 54. The restrictor plate 54 extends inwardly from the first end 26 to a restrictor opening 56. The restrictor opening 56 is fluidically connected with the inlet port 22 such that any steam passing through the inlet port 22 and into the chimney chamber 52 must first pass through the restrictor opening 56. The second end 28 of the chimney 24 is fluidically connected to the nozzle apparatus 30. In some embodiments, the chimney chamber 52 is directly connected to a lower cooktop surface 58 (FIG. 4) that surrounds the outlet port 16, and the nozzle apparatus 30 is directly connected to the outlet port 16. In some embodiments, the chimney chamber 52 may fluidically connect to the outlet port 16 via the nozzle apparatus 30.

Figure 3:
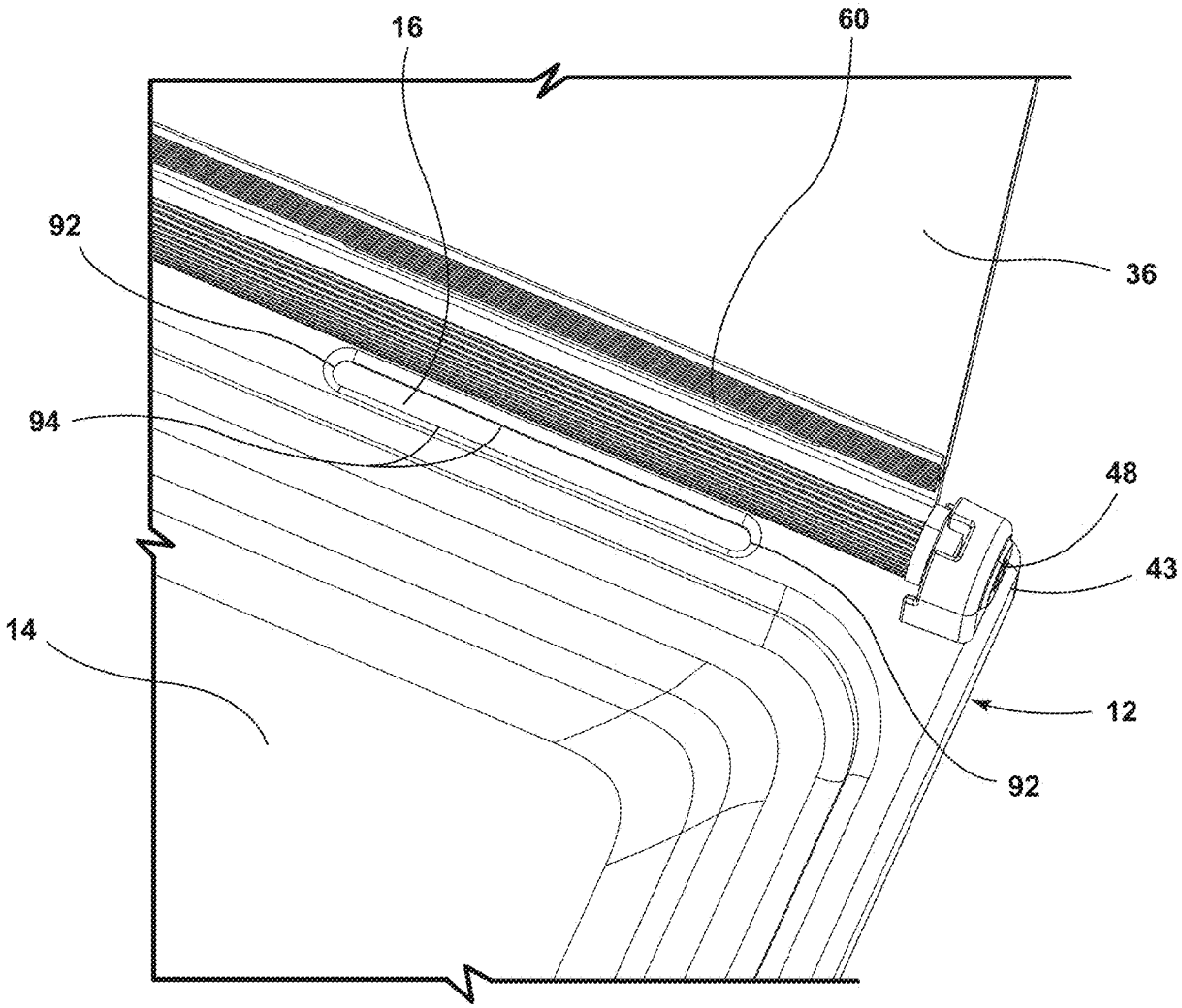
FIG. 3 is a top perspective view of the cooking appliance with the nozzle apparatus removed therefrom according to an aspect of the present disclosure.

FIG. 3 is a top perspective view of the cooking appliance 10 wherein the nozzle apparatus 30 has been removed from the outlet port 16. In some embodiments, the outlet port 16 is elongated and extends along the width of the cooktop 14. The cover 36 may include a slot 60 that becomes substantially aligned with the outlet port 16 when the cover 36 is in the closed position. More particularly, the slot 60 (FIG. 1) may be located closer to the front edge 42 than the outlet port 16 when the cover 36 is in the closed position. As such, the slot 60 is aligned with a steam path defined by the angle of the aperture 34 as previously described. In some embodiments, the slot 60 is elongated and extends along the width of the cooktop 14 a greater distance than the outlet port 16 to accommodate an expansion of the steam exiting the nozzle apparatus 30. In some embodiments, a gasket (not shown) of elastic material may surround the slot 60 that contacts on or around the nozzle apparatus 30 to facilitate steam from the nozzle apparatus 30 through the slot 60.

Figure 4:
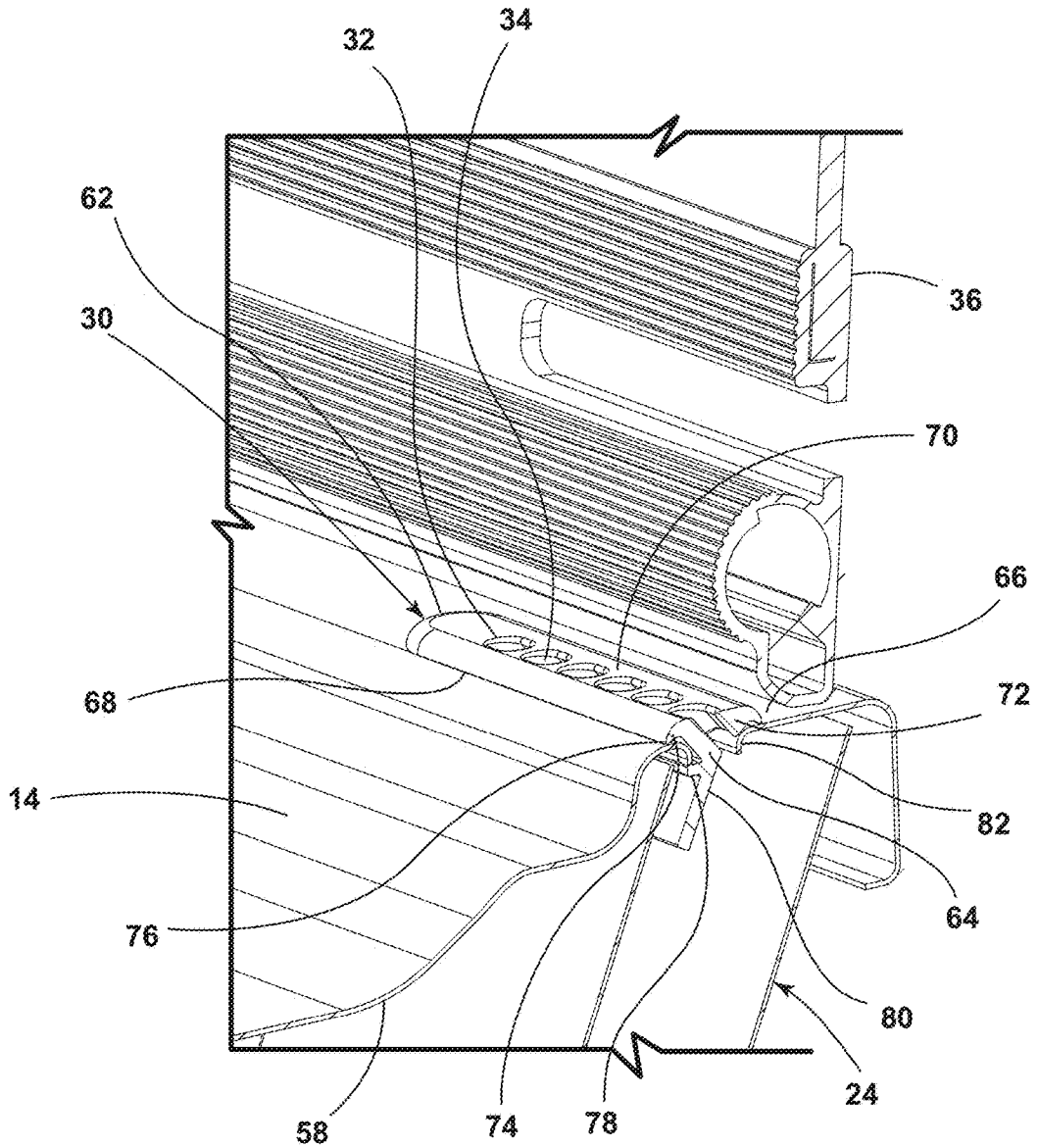
FIG. 4 is a cross-sectional view of the cooking appliance and the nozzle apparatus installed therein according to an aspect of the present disclosure.

FIG. 4 is a cross-sectional view of the cooking appliance 10 and the nozzle apparatus 30 installed therein. The nozzle apparatus 30 includes a head 62 and a stem 64 connected to the head 62. During assembly, the stem 64 is placed within the outlet port 16 and the head 62 seals against an upper surface 66 of the cooktop 14. The head 62 cantilevers out from the stem 64 to an outer perimeter 68. The head 62 includes an upper head surface 70 and a lower head surface 72. The outer perimeter 68 may be chamfered (e.g. curved) from the upper head surface 70 to the lower head surface 72. The lower head surface 72 surrounding the stem 64 may be cup-shaped. For example, the lower head surface 72 may define a groove 74 that extends along the outer perimeter 68 and defines an angled flange 76 that extends along the outer perimeter 68. The flange 76 directly contacts the upper surface 66 of the cooktop 14 to seal thereagainst. A detent 78 extends from the stem 64 and interfaces with the lower cooktop surface 58 to secure the flange 76 to the upper surface 66 of the cooktop 14. In some embodiments, the nozzle apparatus 30, or portions thereof, may be formed of material with elastic memory, such as material containing heat resistant polymer, food grade silicone, platinum silicone, and/or the like. In some embodiments, the nozzle apparatus 30, or portions thereof, may be formed of other heat resistant materials, such as material containing aluminum, steel, rust resilient metals, and/or the like.

The stem 64 includes a deflector plate 80 extending along one side of the at least one aperture 34. When installed, the deflector plate 80 may extend into the chimney chamber 52 parallel with the third upward angle of the third section 50. In some embodiments, the deflector plate 80 is configured to be located on the side of the at least one aperture 34 nearest the front edge 42 of the cooktop 14. In some embodiments, the detent 78 extends from the deflector plate 80 and is, likewise, configured to extend towards the front edge 42 of the cooktop 14. A portion of the upper surface 66 of the cooktop 14 defining the outlet port 16 may bend downwardly into the outlet port 16 to define a rim 82 abutting the detent 78.

Figure 5:
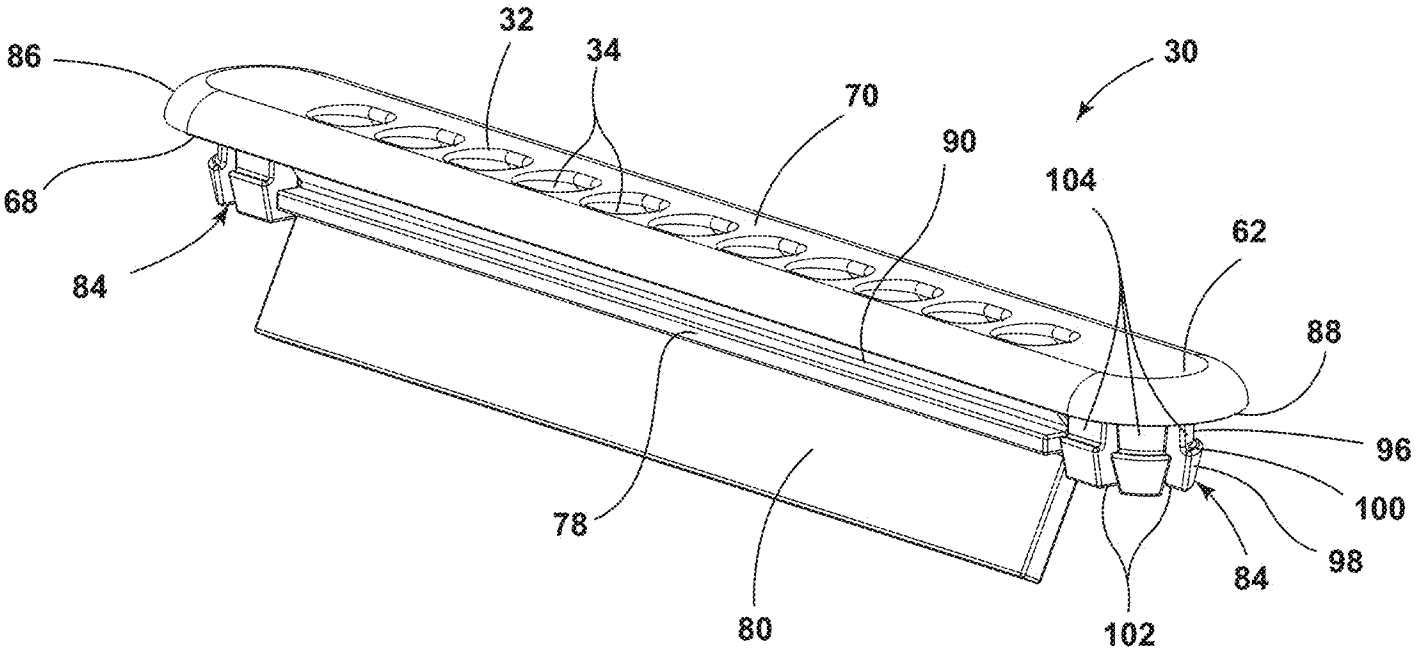
FIG. 5 is a front perspective view of the nozzle apparatus according to an aspect of the present disclosure.

FIG. 5 is a front perspective view of the nozzle apparatus 30. The nozzle apparatus 30 includes at least one connector extending from the lower head surface 72 of the head 62 that is configured to be connected to or around the outlet port 16, for example, via a snap-fit. More particularly, the at least one connector may include a pair of posts 84 on opposite sides of the at least one aperture 34 in a direction of the width of the cooktop 14. More particularly, the outer perimeter 68 of the head 62 may be elongated and extend between a first end 86 and a second end 88 and spaced by a pair of side edges 90. The first end 86 and the second end 88 may be semi-circular and the side edges 90 may be linear and substantially parallel with the rear edge 43 of the cooktop 14. The at least one aperture 34 may include a plurality of apertures 34 (e.g. five or more, fifteen or less, or, as illustrated, ten) that are sequentially spaced and linearly aligned between the first end 86 and the second end 88. Each of the apertures 34 may be equally spaced between the pair of side edges 90 and may define a circular cross-section. Each of the posts 84 are located adjacent to opposite ends 86, 88.

With reference now to both FIGS. 3 and 5, the outlet port 16 may be similarly shaped, but with a generally smaller profile, to the head 62 and extend between opposite outlet ends 92 that are spaced from outlet side edges 94. The outlet ends 92 may be semi-circular, and the outlet side edges 94 may be linear. Each post 84 includes a post body 96 extending to a flanged end 98. The flanged end 98 extends outwardly from the post body 96 and includes an interface surface 100 that contacts the lower cooktop surface 58. Each post 84 defines at least one recess 102 that facilitates a snap-type connection with the cooktop 14. The at least one recess 102 may include a pair of opposing recesses 102 that are substantially perpendicular relative to one another that provide flexibility (e.g. contraction) in multiple directions during installation. As such, each post 84 may include a plurality of legs 104 defined by the at least one recess 102, for example, four legs 104 defined by opposing recesses 102. Each leg 104 may, in combination, define the flanged end 98 and interface surface 100. The interface surface 100 may be at least partially semi-circular to interface with the opposite outlet ends 92 and partially linear to interface with the outlet side edges 94. Therefore, each post 84 may be spaced to be adjacent to the opposite outlet ends 92 when installed.

Figure 6:
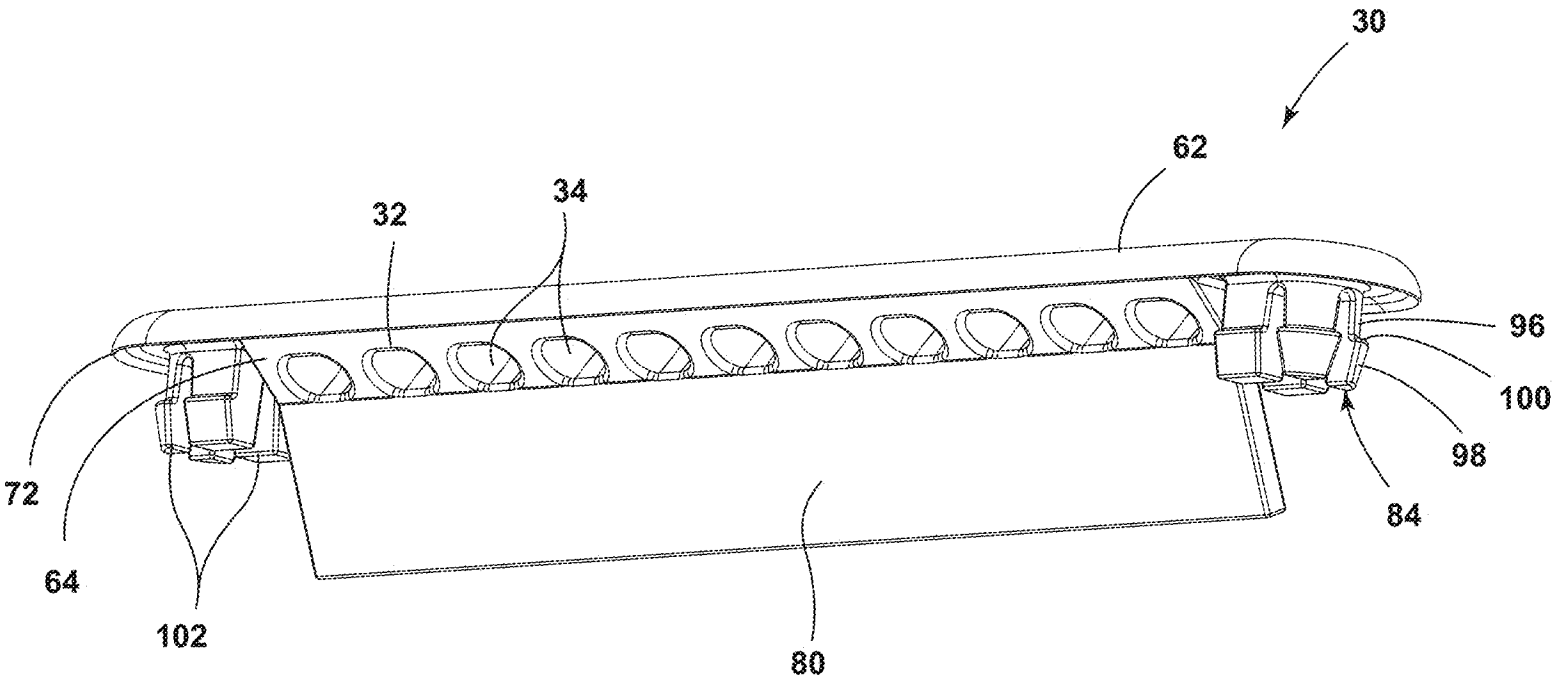
FIG. 6 is a rear perspective view of the nozzle apparatus according to an aspect of the present disclosure.

FIG. 6 is a rear perspective view of the nozzle apparatus 30. The deflector plate 80 extends at an angle relative to the posts 84 and an angle relative to the at least one aperture 34. In some embodiments, the angle relative to the at least one aperture 34 is greater than the angle relative to the posts 84. Therefore, while in use, the deflector plate 80 routes steam in a first direction relative to the posts 84 towards the at least one aperture 34 whereat the steam is routed in a second direction through the at least one aperture 34.

Figure 7:
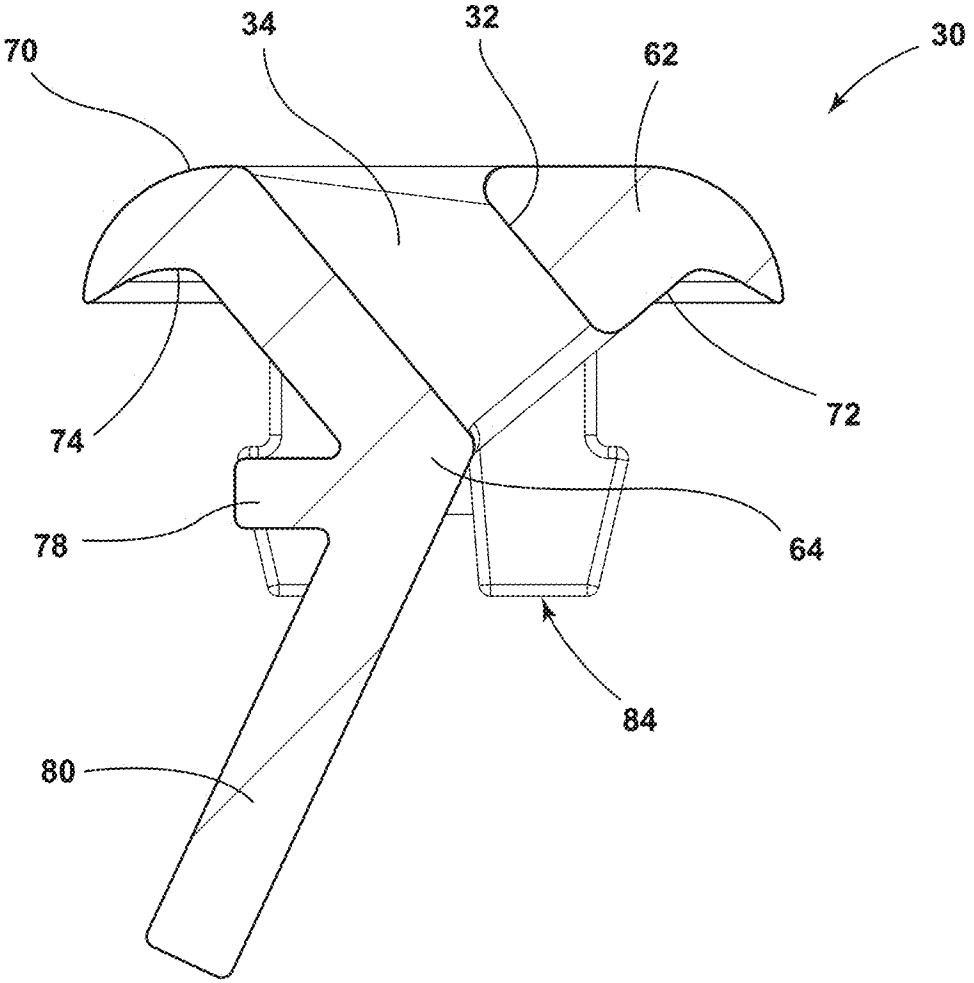
FIG. 7 is a cross-sectional view of the nozzle apparatus according to an aspect of the present disclosure.

FIG. 7 is a cross-sectional view of the nozzle apparatus 30. The at least one aperture 34 may be oriented at an angle less than 90° from the upper head surface 70 of the head 62 and/or the interface surface 100 for the posts 84, for example, less than 80°, less than 70°, less than 60°, less than 50°, less than 40°, less than 30°, less than 20°, between 30° and 60°, between 35° and 55°, or about 45°. In some embodiments, the detent 78 extends on a plane that is parallel to the upper head surface 70 of the head 62. In some embodiments, the interface surface 100 extends on the plane of the detent 78.

Figure 8B:
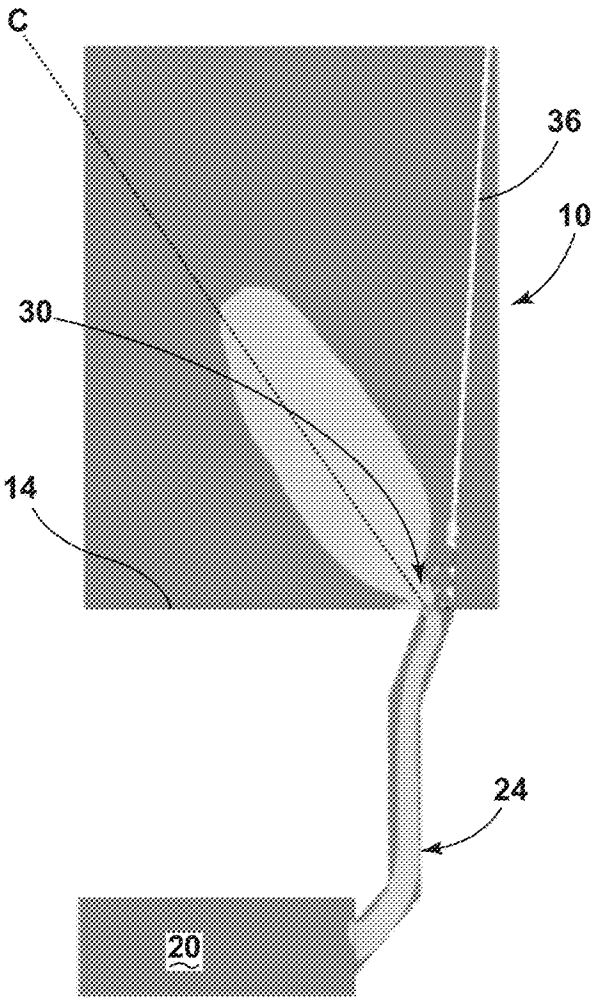
FIG. 8B is a heat map of steam exiting the cooking appliance with the nozzle apparatus according to an aspect of the present disclosure.
Figure 8A:
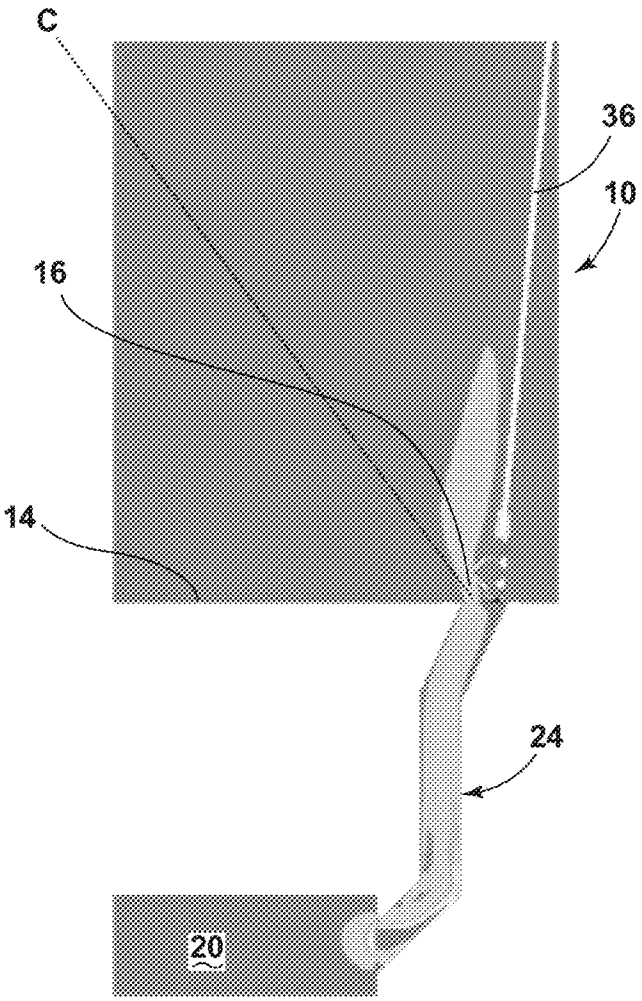
FIG. 8A is a heat map of steam exiting the cooking appliance without the nozzle apparatus according to an aspect of the present disclosure.

FIG. 8A is a heat map of steam exiting the cooking appliance 10 without the nozzle apparatus 30. As illustrated, steam exiting the outlet port 16 extends perpendicularly from the cooktop 14 and therefore contacts the cover 36 and condensates thereon. FIG. 8B is a heat map of steam exiting the cooking appliance 10 and the nozzle apparatus 30. As illustrated, the steam is directed away from the cover 36. More particularly, the steam is directed substantially along a line "C" that extends centrally between the cooktop 14 and the cover 36, for example, within 20° or less, within 15° or less, within 10° or less, or within 5° or less of the line.

Figure 9:
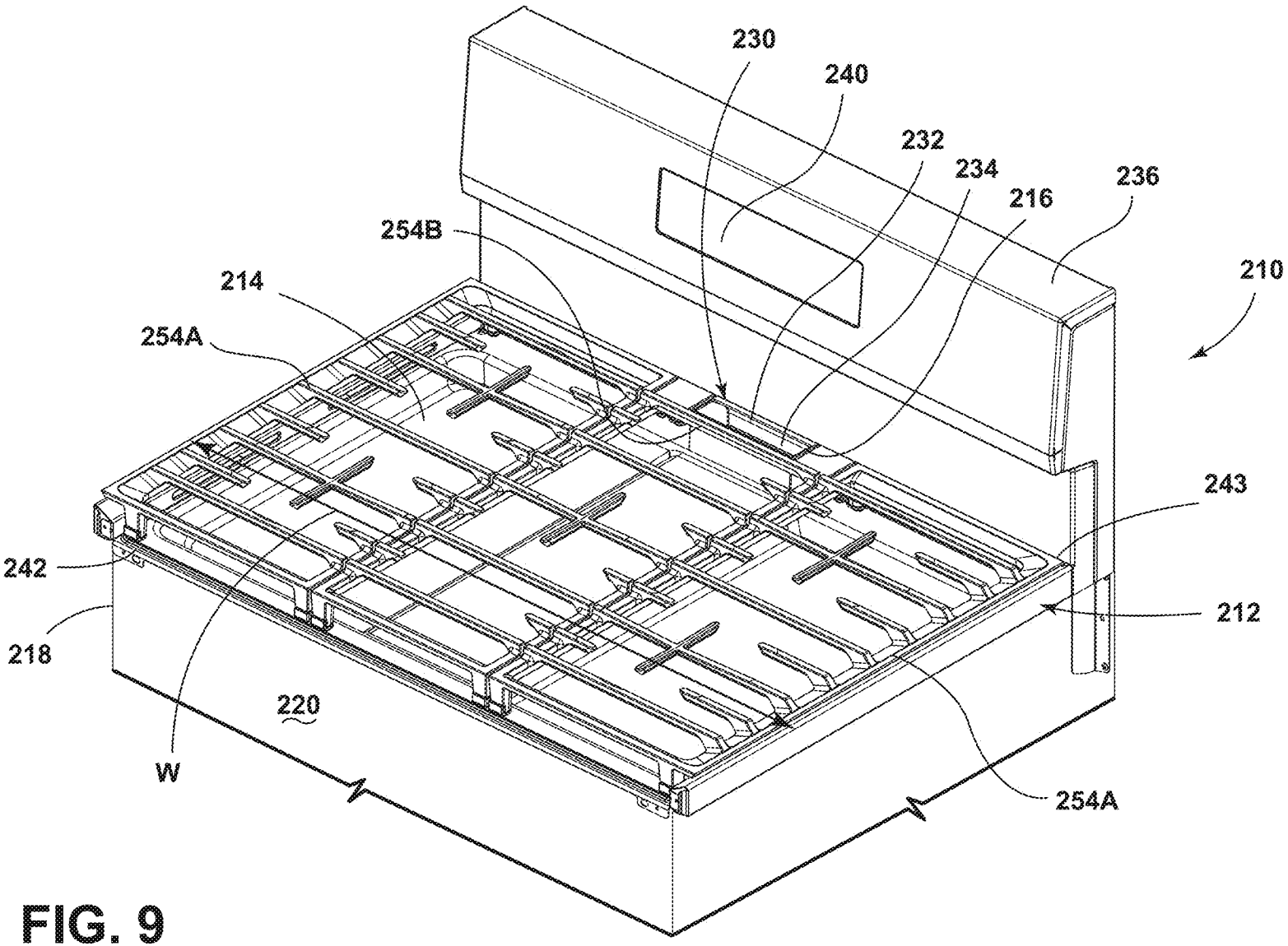
FIG. 9 is a top perspective view of a second embodiment of a cooking appliance with a nozzle apparatus according to an aspect of the present disclosure.

FIG. 9 is a top perspective view of a second embodiment of a cooking appliance 210. The cooking appliance 210 may be configured to be heated with gas. The cooking appliance 210 includes an outer frame surface 212 defining a cooktop 214. The cooktop 214 may include one or more burning elements and an outlet port 216. An inner frame surface 218 defines a heating cavity 220 disposed below the cooktop 214 and within the outer frame surface 212. The inner frame surface 218 defines an inlet port 22. A chimney 224 (FIG. 10) extends between a first end 226 connected to an inlet port (not shown) in the heating cavity 220 and a second end 228 connected to the outlet port 216 for directing steam from the heating cavity 220 outside of the cooking appliance 210. A nozzle apparatus 230 is located at least partially in or adjacent to the outlet port 216. The nozzle apparatus 230 includes an inner wall 232 defining at least one aperture 234 (e.g. one, two, three, four, five, six, seven, eight, nine, ten, or more).

The at least one aperture 234 may include a single aperture 234 oriented at an acute angle relative to the cooktop 214 and a transverse angle relative to the outlet port 216. The aperture 34 may be oriented at an angle less than 90° from the cooktop 14, for example, less than 80°, less than 70°, less than 60°, less than 50°, less than 40°, less than 30°, less than 20°, between 30° and 60°, between 35° and 55°, or about 45°. The cooktop 214 extends between a front edge 242 and a rear edge 243. The outlet port 216 may be located near the rear edge 243 and the nozzle apparatus 230 is configured to direct steam towards the front edge 242. A rear console 236 extends upwardly from the rear edge 243 of the cooktop 214 and includes a user interface 240 for controlling functionalities of the cooking appliance 210. The rear console 236 contains electric components (not shown), which may be susceptible to heat damage. As such, oftentimes, more expensive materials are used such that steam exiting the outlet port 216 does not overheat the electric components. The nozzle apparatus 230, therefore, directs steam away from the rear console 236 to limit heat exposure to the electric components.

Figure 10:
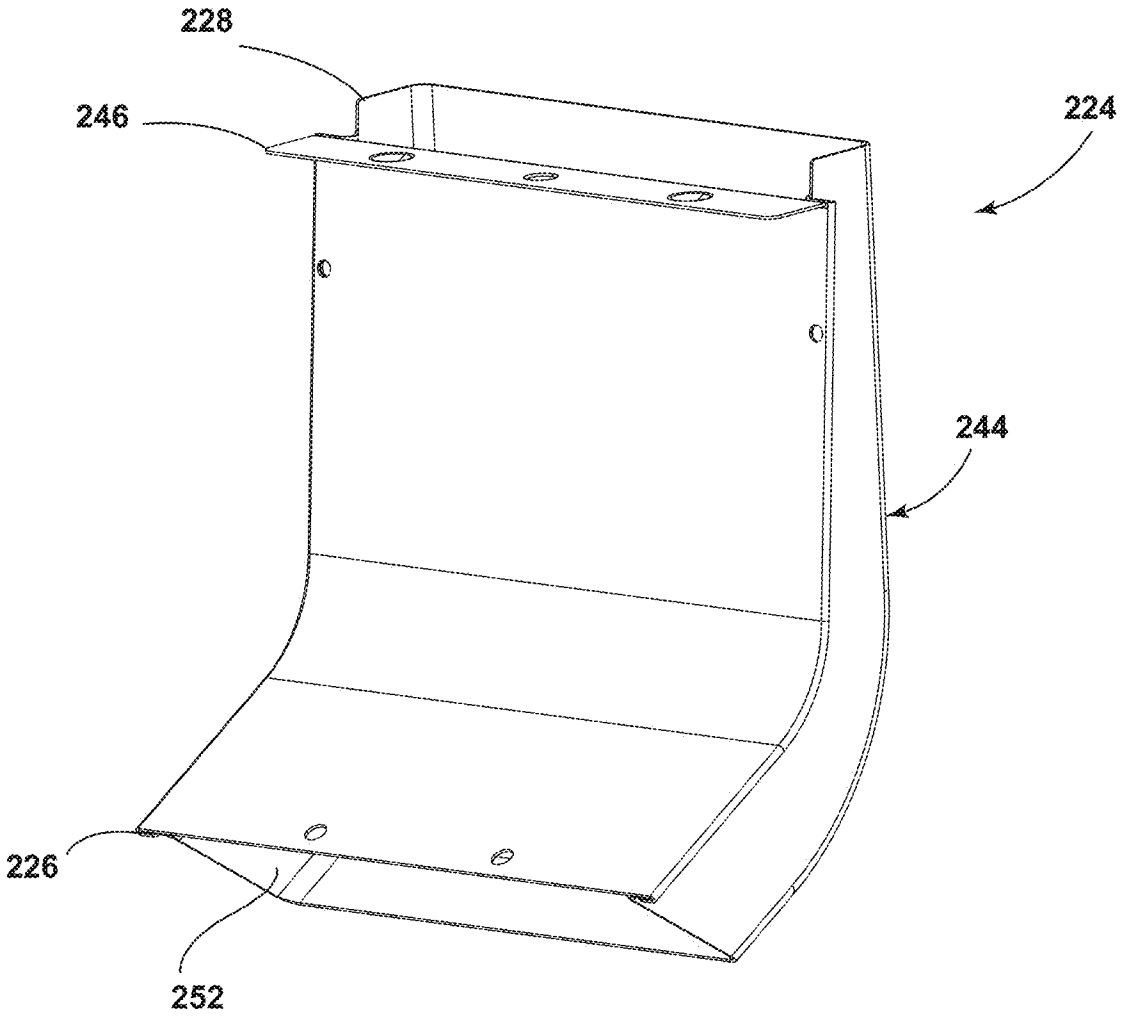
FIG. 10 is a top perspective view of a chimney of the cooking appliance according to an aspect of the present disclosure.
Figure 12:
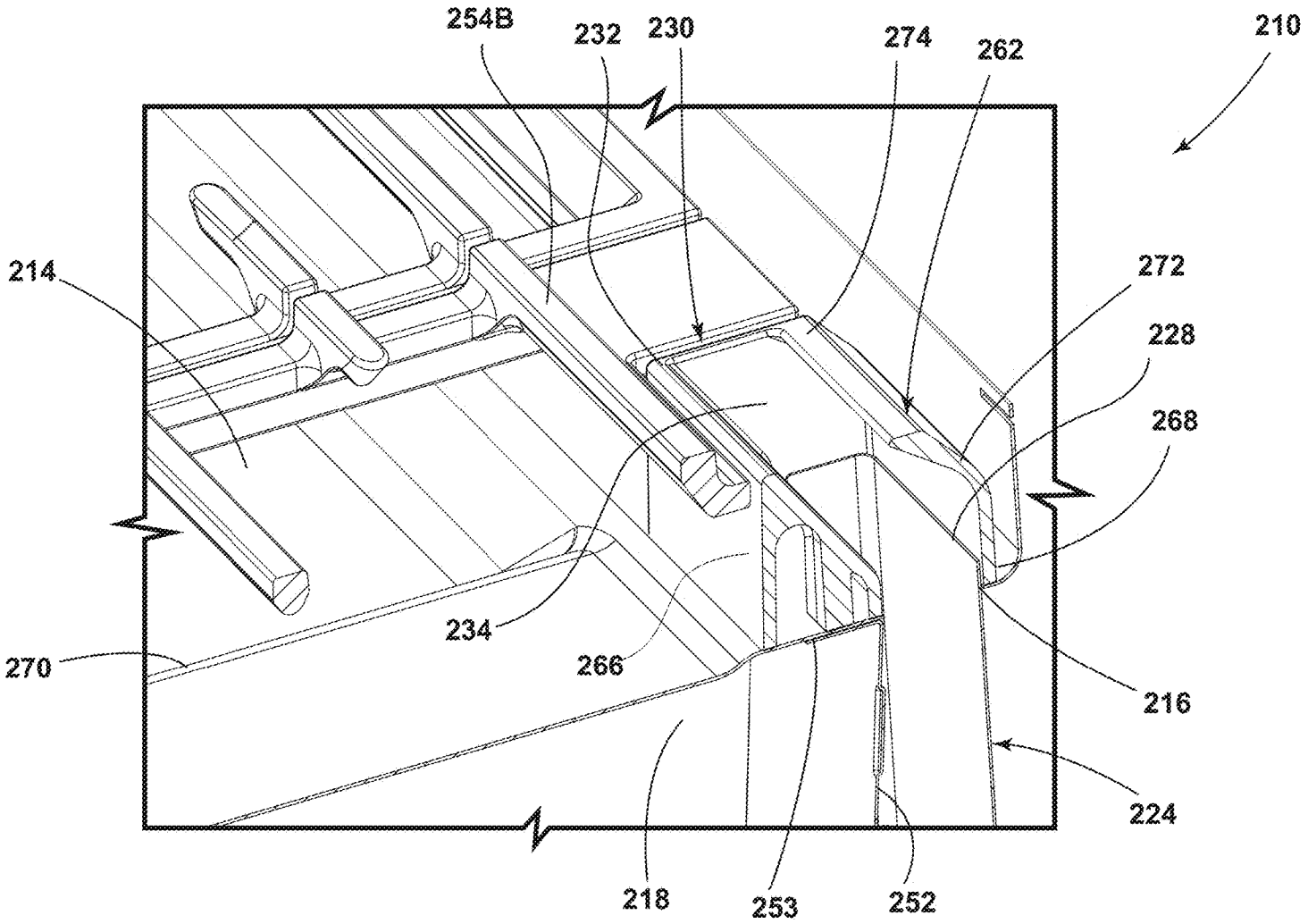
FIG. 12 is a cross-sectional view of the cooking appliance and the nozzle apparatus installed therein according to an aspect of the present disclosure.

FIG. 10 is a top perspective view of the chimney 224, wherein the chimney 224 is isolated from the cooking appliance 210. The chimney 224 includes a chimney body 244 extending between the first end 226 and a second end 228. The chimney body 244 may be curved such that it can connect to a rear wall or top wall of the inner frame surface 218, such that steam may be routed at least partially horizontally through the inlet port. The chimney body 244 defines a chimney chamber 252 extending between the first end 226 and the second end 228. The chimney body 244 includes a bracket 246 for connection to the cooktop 214 adjacent to the second end 228. The bracket 246 may be spaced from the second end 228 such that at least part of the second end 228 extends through the outlet port 216 when installed (FIG. 12). From the first end 226, the chimney body 244 may taper outwardly such that a cross-section of the chimney chamber 252 gets progressively smaller towards the second end 228. In other words, the chimney body 244 tapers inwardly along a width "W" (FIG. 9) of the cooktop 214 such that the cross-section of the chimney chamber 252 gets progressively smaller in a direction from the first end 226 towards the second end 228. As such, the first end 226 may be narrower along the width of the cooktop 214 than the second end 228. The outlet port 216 may be located centrally along the width of the cooktop 214. The second end 228 of the chimney 224 is fluidically connected to the nozzle apparatus 230. In some embodiments, the chimney chamber 252 is directly connected to a lower cooktop surface 253 (FIG. 12) that surrounds the outlet port 216, and the nozzle apparatus 230 is directly connected to the outlet port 216. In some embodiments, the chimney chamber 252 may fluidically connect to the outlet port 216 via the nozzle apparatus 230.

Figure 11:
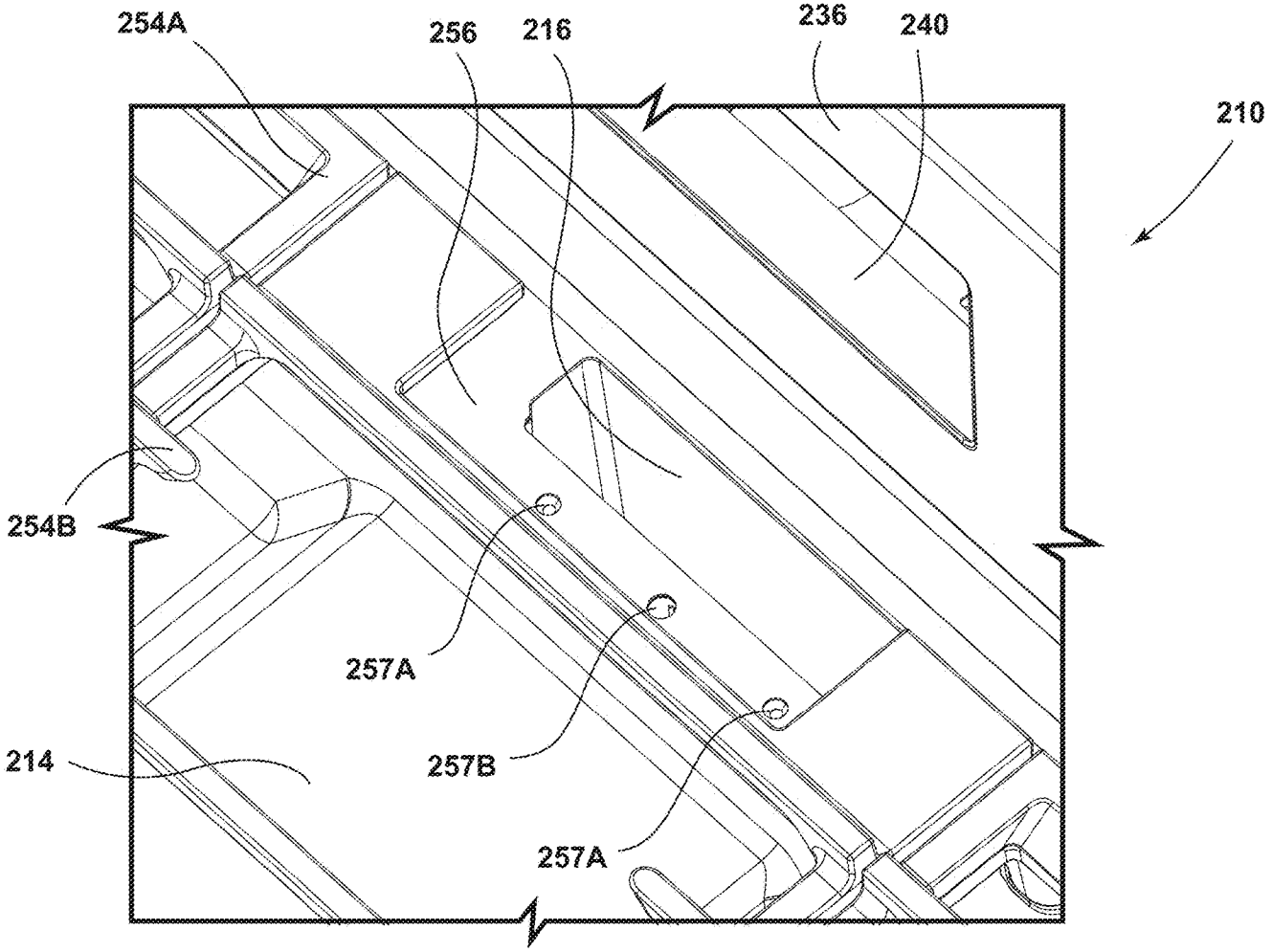
FIG. 11 is a top perspective view of the cooking appliance with the nozzle apparatus removed therefrom according to an aspect of the present disclosure.

FIG. 11 is a top perspective view of the cooking appliance 210 wherein the nozzle apparatus 230 has been removed from the outlet port 216. In some embodiments, the outlet port 216 is elongated and extends along the width of the cooktop 214. The cooktop 214 may include at least one grate 254A-B (e.g. a plurality of several grates 254A-B). The at least one grate 254A-B may include a port opening 256 that is oriented directly above the outlet port 216 and the nozzle apparatus 230. The port opening 256 may be U-shaped such that it does not close on a side closet to the rear edge 243. In examples with the plurality of several grates 254A-B, there are a plurality of standard grates 254A and a port grate 254B that may be the only grate 254B with a port opening 256. A surface of the cooktop 214 surrounding the outlet port 216 may define holes 257A-B that accommodate fastening elements that connect the nozzle apparatus 230 to the cooktop 214. The holes 257A-B may include at least one first hole 257A for accommodating a fastener (e.g. a threaded shaft) and at least one second hole 257B for accommodating at least one portion of the nozzle apparatus 230 in a press and/or snap fit relationship.

FIG. 12 is a cross-sectional view of the cooking appliance 210 and the nozzle apparatus 230 installed therein. The nozzle apparatus 230 includes a nozzle body 262 defining a pair of sidewalls 264 (FIG. 13) spaced apart by a front wall 266 and a rear wall 268. During assembly, the nozzle body 262 is placed within the outlet port 216 and seals against an upper surface 270 of the cooktop 214. The rear wall 268 includes an angled section 272 (e.g. a curve) such that less material is needed to form the angle of the aperture 234. The nozzle body 262 includes an upper surface 274 and a lower body surface 276. An outer perimeter of the upper surface 274 may be smaller than a perimeter of the lower body surface 276. In some embodiments, the nozzle apparatus 230 or portions thereof may be formed of material with elastic memory, such as material containing heat resistant polymer, food grade silicone, platinum silicone, and/or the like. In some embodiments, the nozzle apparatus 230, or portions thereof, may be formed of other heat resistant materials, such as material containing aluminum, steel, rust resilient metals, and/or the like.

With continued reference to FIG. 12, the nozzle apparatus 230 includes at least one connector extending from the lower body surface 276 of the nozzle body 262 that is configured to be connected to or around the outlet port 216, for example, via a snap-fit. For example, the at least one connector may include a post 278 that extends from the lower body surface 276 of the nozzle apparatus 230 for connection to the second hole 257B located near the outlet port 216. The post 278 may include one or more snap-fit features (not shown), for example, the same features of the posts 84 of the first embodiment. The at least one aperture 234 may include a single aperture 234 that extends between the upper surface 274 and the lower body surface 276. In some embodiments, the second end 228 of the chimney 224 extends into the aperture 234 from the lower body surface 276. The upper surface 274 may at least partially extend into the port opening 256 in the grates 254A-B.

Figure 13:
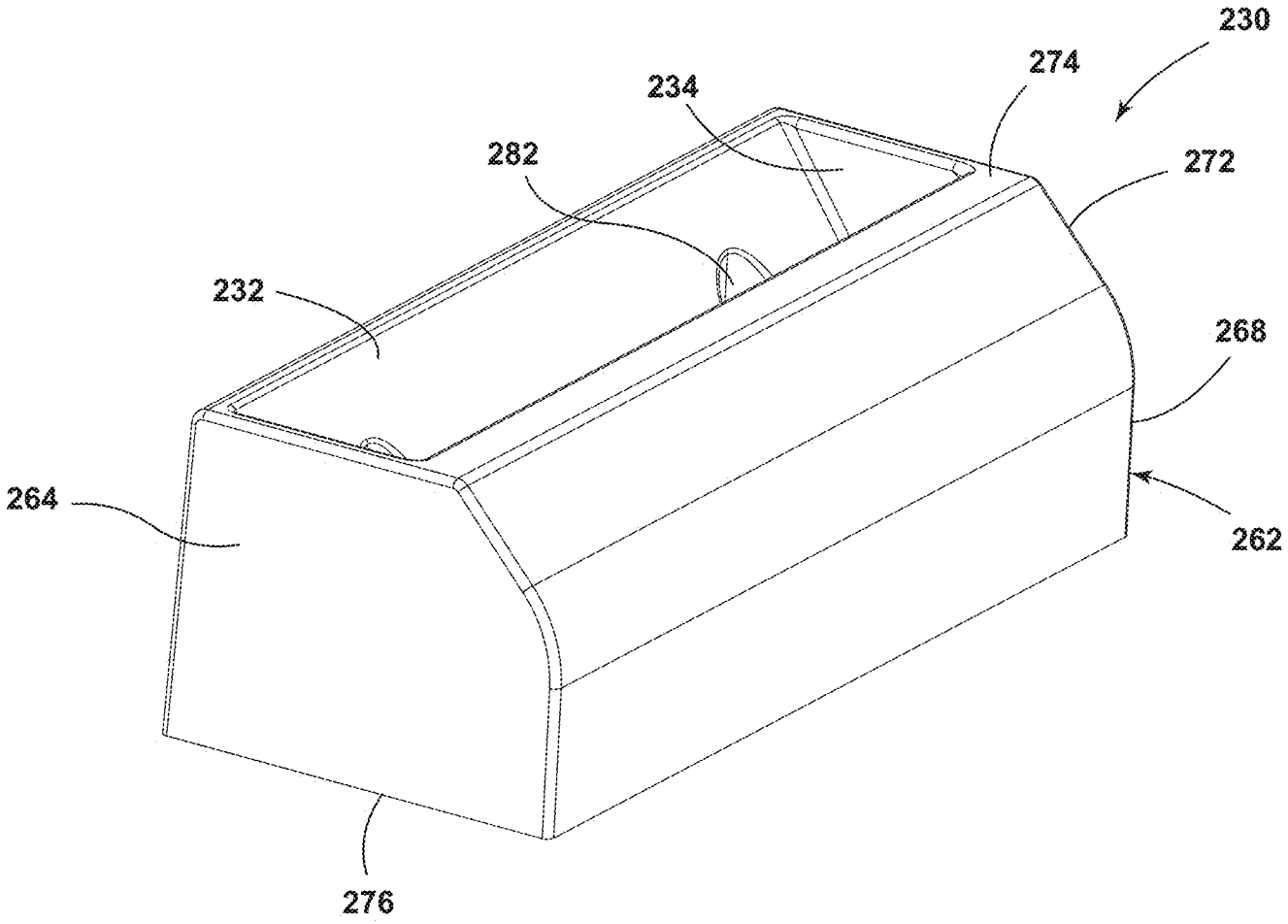
FIG. 13 is a front perspective view of the nozzle apparatus according to an aspect of the present disclosure.

FIG. 13 is a front perspective view of the nozzle apparatus 230. The sidewalls 264 and the front wall 266 may be planar and the rear wall 268 may be angled (e.g. curved). The inner wall 232 of the nozzle body 262 defining the aperture 234 may include at least one bore 282 for accommodating fasteners directed to or from the at least one first hole 257A adjacent to the outlet port 216.

Figure 14:
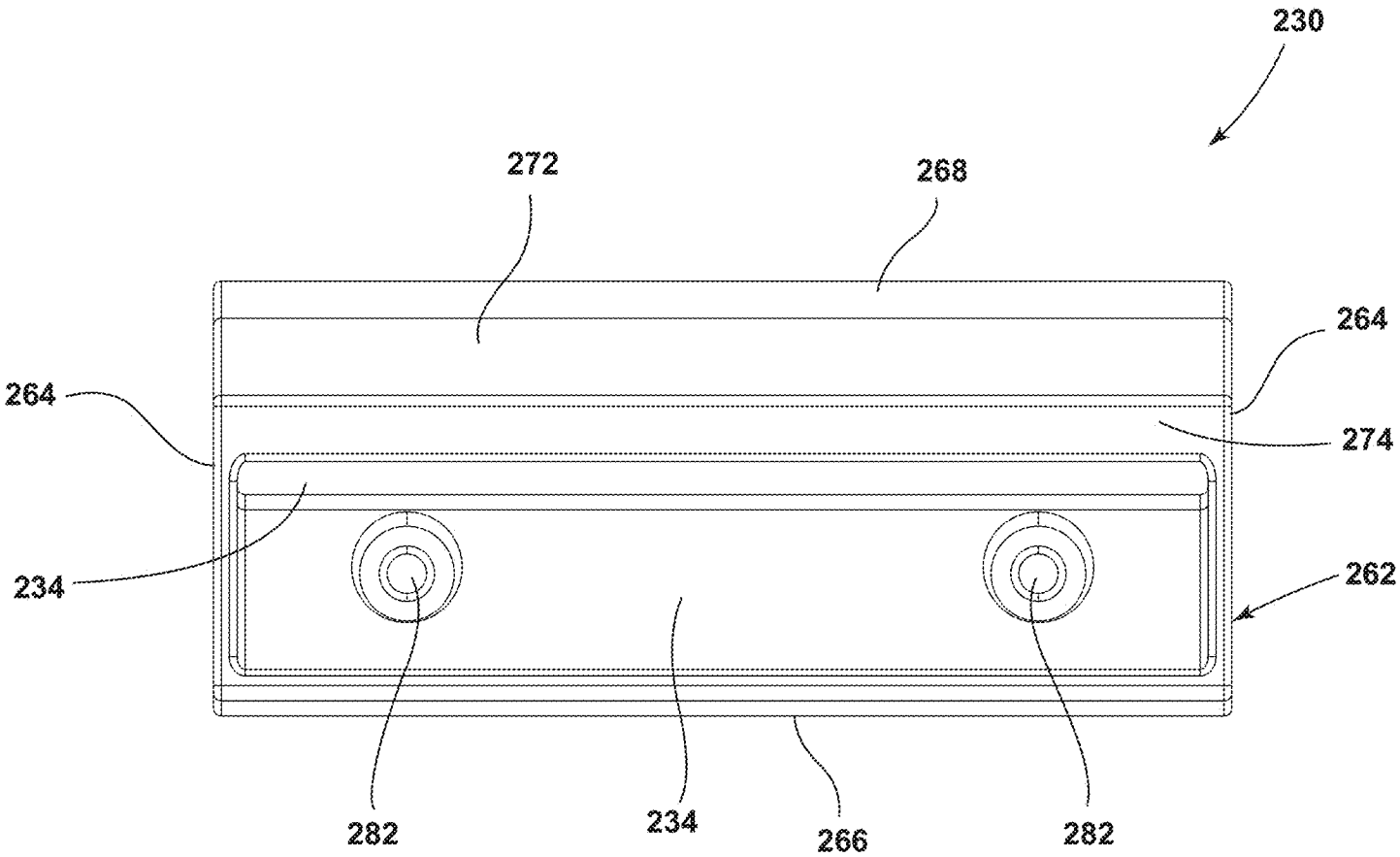
FIG. 14 is a top view of the nozzle apparatus according to an aspect of the present disclosure.

FIG. 14 is a top view of the nozzle apparatus 230 illustrating a pair of bores 282 for cooktops 214 that include a pair of first holes 257A (FIG. 11).

Figure 15:
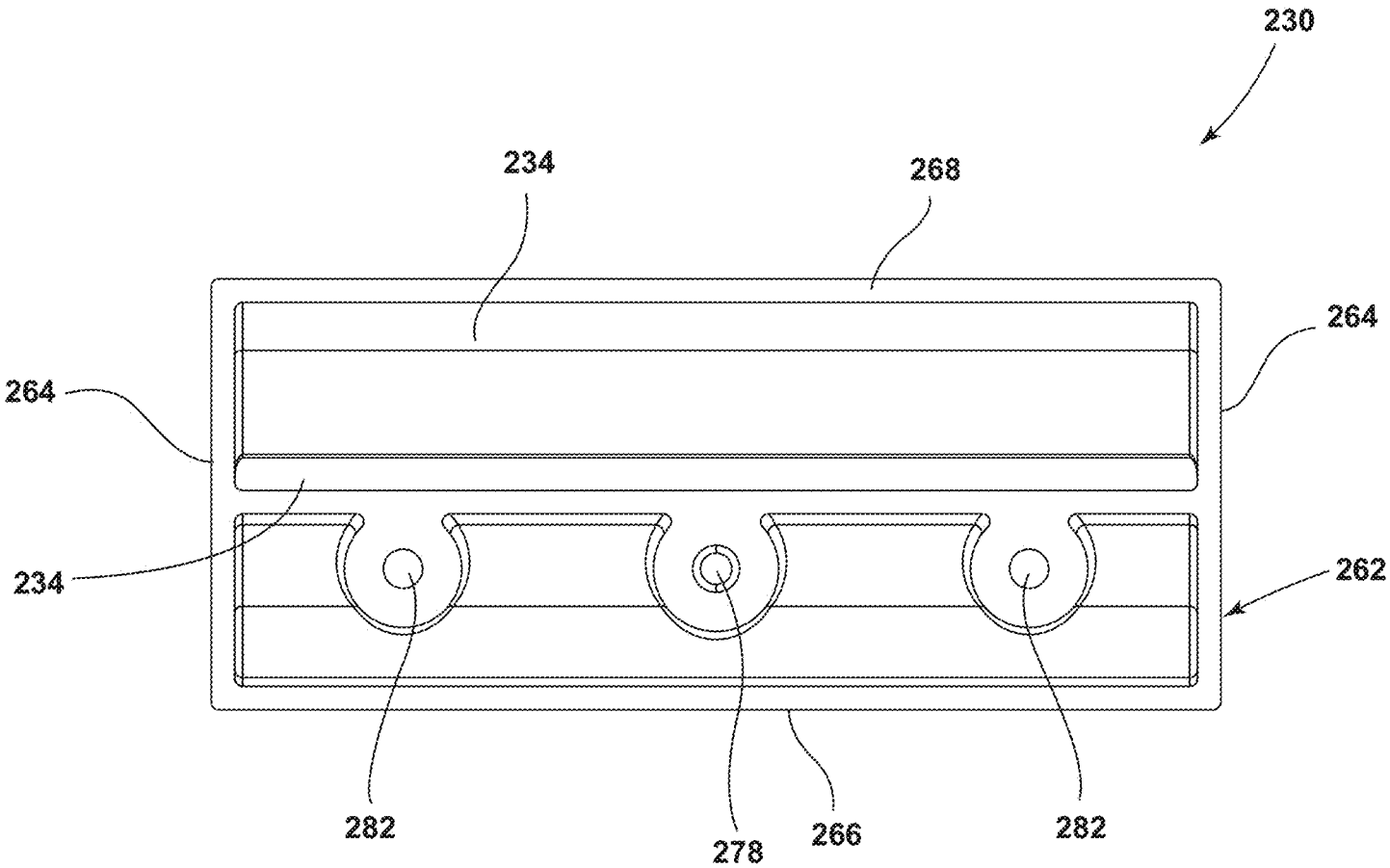
FIG. 15 is a bottom view of the nozzle apparatus according to an aspect of the present disclosure.

FIG. 15 is a bottom view of the nozzle apparatus 230 illustrating the post 278 located between the pair of first holes 257A (e.g. centrally). The aperture 234 may define a generally rectangular cross-section.

Figure 16:
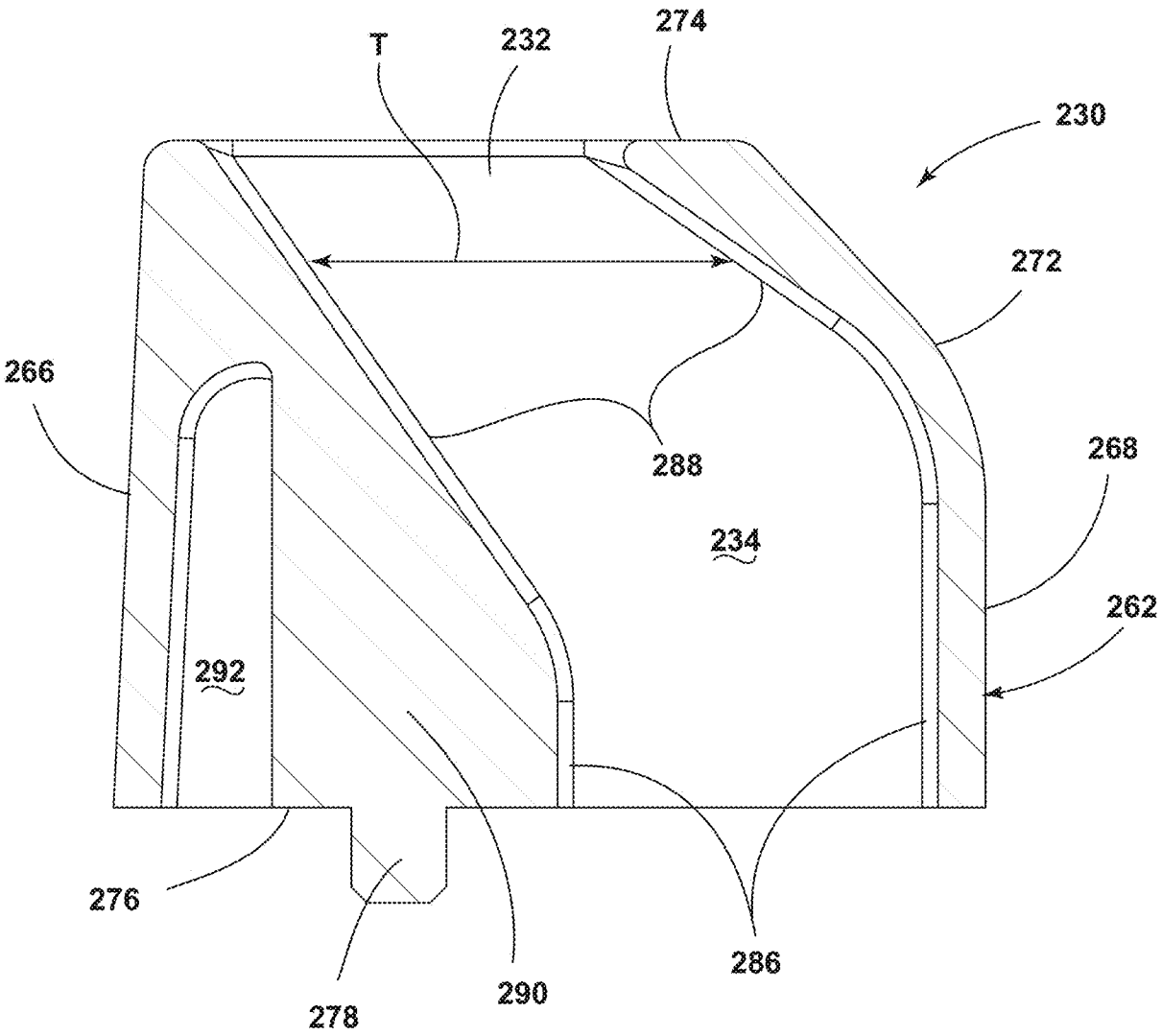
FIG. 16 is a cross-sectional view of the nozzle apparatus according to an aspect of the present disclosure.

FIG. 16 is a cross-sectional view of the nozzle apparatus 230. The inner wall 232 defining the aperture 234 may include an entry section 286 extending from the lower body surface 276 of the nozzle body 262 and an exit section 288 extending from the entry section 286 to the upper surface 274. The entry section 286 may extend at a first angle, and the exit section 288 may extend at a second angle. The first angle may be different than the second angle. For example, the first angle may be substantially vertical (i.e. perpendicular) from the lower body surface 276 and the second angle may be between vertical and the lower body surface 276. In other words, the exit section 288 is configured to route steam substantially along a line "C" (FIGS. 17A and 17B) that extends centrally between the cooktop 214 and the rear console 236, for example, within 20° or less, within 15° or less, within 10° or less, or within 5° or less of the line. The aperture 234 may extend between the rear wall 268 and the front wall 266 to define a thickness "T". The thickness may vary between the upper surface 274 and the lower body surface 276. For example, the thickness may be reduced near the upper surface 274 to accelerate velocity of the steam. The thickness may be reduced via the rear wall 268.

A deflector plate 290 may extend between the front wall 266 and the rear wall 268. The defector plate 290 may at least partially define the aperture 234 opposite the rear wall 268. The deflector plate 290 may extend to the lower body surface 276 and the post may extend from the deflector plate 290 at the lower body surface 276. A space 292 may be located between the front wall 266 and the deflector plate 290 to permit flexing of the nozzle apparatus 230 without changing the thickness of the aperture 234.

Figure 17B:
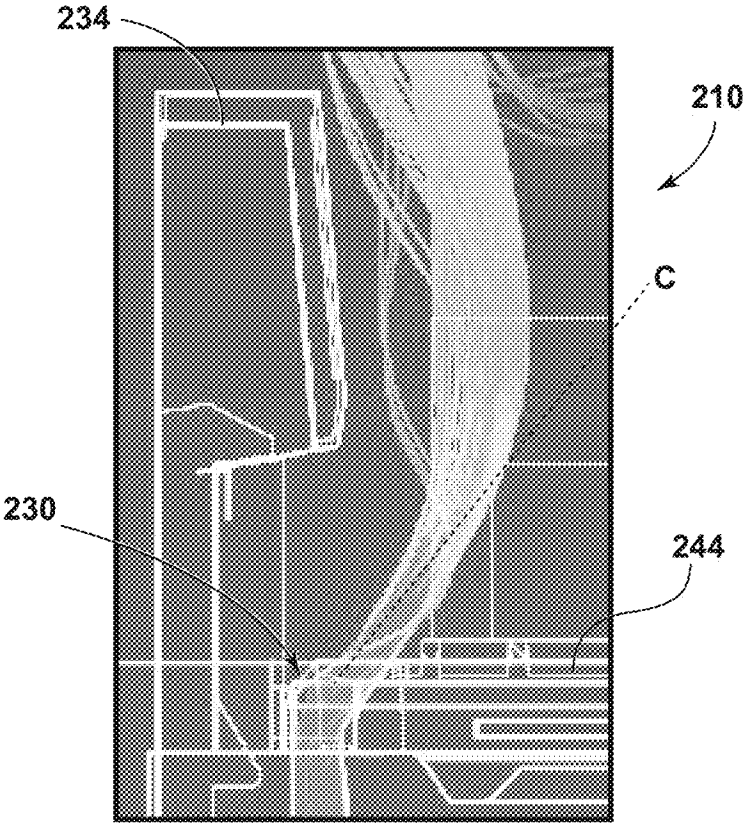
FIG. 17B is a heat map of steam exiting the cooking appliance with the nozzle apparatus according to an aspect of the present disclosure.
Figure 17A:
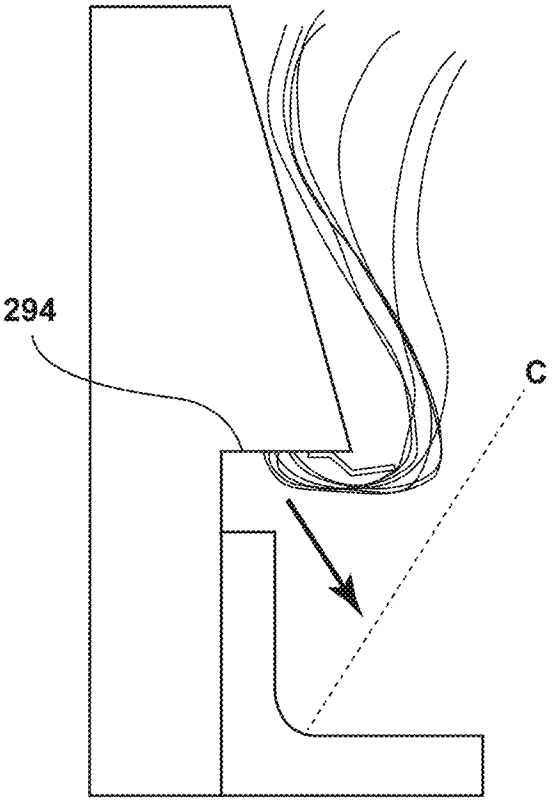
FIG. 17A is a heat map of steam exiting a cooking appliance with a traditionally located outlet port.

As illustrated in FIG. 17A, steam exiting a traditional outlet port 294 without the nozzle apparatus 230 extends perpendicularly from the cooktop 214 and therefore contacts the rear console 236, condensating thereon and heating electric components of the rear console 236. FIG. 17B is a heat map of steam exiting the cooking appliance 210 and the nozzle apparatus 230. As illustrated, the steam is directed away from the rear console 236. More particularly, the steam is directed substantially along the line "C" that extends centrally between the cooktop 214 and the rear console 236.

In some embodiments, the nozzle apparatus 30, 230 may be configured to be permanently attached to the outlet port 16, 216 and/or the cooktop 14, 214. More particularly, once installed, the nozzle apparatus 30, 230 may only be removed from the outlet port 16, 216 and/or the cooktop 14, 214 via breaking the post 84, 278 and/or removing fasteners from the first holes 257A. Because the nozzle apparatus 30, 230 may not be easy to remove, users are less likely to perform self-service that can negatively impact the cooking appliance 10, 210. While not limited thereto, the nozzle apparatus 30 in accordance with the first embodiment may be configured for an electric cooking appliance with a lower flow requirement. The plurality of apertures 34 are selected for increasing the velocity of the steam. While not limited thereto, the nozzle apparatus 230 in accordance with the second embodiment may be configured for a gas cooking appliance with a higher flow requirement. The single aperture 234 is selected for increasing the velocity of the steam.

The invention disclosed herein is further summarized in the following paragraphs and is further characterized by combinations of any and all of the various aspects described therein.

According to another aspect of the present disclosure, a cooking appliance is provided. The cooking appliance comprises an outer frame surface defining a cooktop and the cooktop defines an outlet port. An inner frame surface defines a heating cavity disposed below the cooktop and within the outer frame surface. The inner frame surface defines an inlet port and a chimney extends between a first end connected to the inlet port and a second end connected to the outlet port for directing steam from the heating cavity outside of the cooking appliance. A nozzle apparatus is connected around the outlet port and includes an inner wall defining at least one aperture. The at least one aperture is oriented at an acute angle relative to the cooktop.

According to another aspect, the nozzle apparatus includes at least one post for connection to the cooktop.

According to another aspect, the at least one post includes a post body extending to a flanged end, the flanged end extending outwardly from the post body to define an interface surface.

According to another aspect, each post defines at least one recess that facilitates a snap-type connection.

According to another aspect, each post extends into the outlet port.

According to another aspect, the at least one recess includes a pair of opposing recesses.

According to another aspect, the at least one aperture includes a plurality of apertures that are sequentially spaced and linearly aligned.

According to another aspect, the cooking appliance is configured to be heated by electricity.

According to another aspect, the nozzle apparatus includes a head and a stem, wherein the head interfaces with an upper surface of the cooktop and the stem is at least partially located in the outlet port.

According to another aspect, the nozzle apparatus further includes a detent that extends from the stem that interfaces with a lower cooktop surface.

According to another aspect, the nozzle apparatus further includes a deflector plate extending along one side of the at least one aperture.

According to another aspect, the nozzle apparatus includes a nozzle body defining a pair of sidewalls spaced apart by a front wall and a rear wall.

According to another aspect, the at least one aperture includes a single aperture.

According to another aspect, the inner wall defining the single aperture includes an entry section extending from a lower body surface of the nozzle body and an exit section angled from the entry section and that extends from the entry section to an upper surface of the nozzle body.

According to another aspect, the single aperture extends between the rear wall and the front wall to define a thickness and the thickness is reduced near an upper surface of the nozzle body.

According to another aspect, the cooking appliance is configured to be heated with gas.

According to yet another aspect, an electric cooking appliance is provided. The electric cooking appliance comprises an outer frame surface defining a cooktop and the cooktop defines an outlet port. An inner frame surface defines a heating cavity disposed below the cooktop and within the outer frame surface. The inner frame surface defines an inlet port and a chimney extends between a first end connected to the inlet port and a second end connected to the outlet port for directing steam from the heating cavity outside of the cooking appliance. A cover includes a closed position wherein the cover substantially overlaps the cooktop, and an open position wherein the cover is pivoted at an angle from the cooktop. A nozzle apparatus is connected to the outlet port via a snap-fit connection and includes an inner wall defining at least one aperture. The at least one aperture is oriented at an angle substantially centrally between the cooktop and the cover in the open position.

According to another aspect, the cover includes a slot that is substantially aligned with the angle of the at least one aperture.

According to yet another aspect, a gas cooking appliance is provided. The gas cooking appliance comprises an outer frame surface defining a cooktop and the cooktop defines an outlet port. An inner frame surface defines a heating cavity disposed below the cooktop and within the outer frame surface. The inner frame surface defines an inlet port, and a chimney extends between a first end connected to the inlet port and a second end connected to the outlet port for directing steam from the heating cavity outside of the cooking appliance. A rear console includes internal electric components and extends at an angle from cooktop. A nozzle apparatus is connected around the outlet port and includes an inner wall defining at least one aperture. The at least one aperture is oriented at an angle substantially centrally between the cooktop and the rear console.

According to another aspect, the cooking appliance further comprises a plurality of several grates with one of the several grates defining a port opening. The nozzle apparatus is aligned with the port opening.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance comprising:

an outer frame surface defining a cooktop, wherein the cooktop defines an outlet port;

an inner frame surface defining a heating cavity disposed below the cooktop and within the outer frame surface, wherein the inner frame surface defines an inlet port;

a chimney extending between a first end connected to the inlet port and a second end connected to the outlet port for directing steam from the heating cavity outside of the cooking appliance; and a nozzle apparatus, the entire nozzle apparatus is formed of a material having elastic memory wherein the material having elastic memory includes a heat resistant polymer that is sealed around the outlet port via deformation and includes an inner wall defining at least one aperture, wherein the inner wall of the at least one aperture is oriented at an acute angle from the cooktop towards a front edge of the cooktop.

2. The cooking appliance of claim 1, wherein the nozzle apparatus includes at least one post for connection to the cooktop.

3. The cooking appliance of claim 2, wherein the at least one post includes a post body extending to a flanged end, the flanged end extending outwardly from the post body to define an interface surface.

4. The cooking appliance of claim 3, wherein each post defines at least one recess extending from the flanged end that facilitates a snap-type connection.

5. The cooking appliance of claim 4, wherein each post extends into the outlet port.

6. The cooking appliance of claim 4, wherein the at least one recess includes a pair of opposing recesses.

7. The cooking appliance of claim 2, wherein the at least one aperture includes a plurality of apertures that are sequentially spaced and linearly aligned each defining a circular cross-section.

8. The cooking appliance of claim 2, wherein the nozzle apparatus includes a head and a stem, wherein the head includes a lower head surface defining a groove that extends to a downwardly extending flange extending around a perimeter of the head and formed of the material having elastic memory that interfaces with an upper surface of the cooktop and the stem is at least partially located in the outlet port.

9. The cooking appliance of claim 8, wherein the nozzle apparatus further includes a detent that extends from the stem at an acute angle that interfaces with a lower cooktop surface and secures the flange on the upper surface of the cooktop.

10. The cooking appliance of claim 9, wherein the nozzle apparatus further includes a deflector plate extending into the outlet port along one side of the at least one aperture nearest the front edge of the cooktop.

11. The cooking appliance of claim 2, wherein the nozzle apparatus includes a nozzle body defining a pair of sidewalls spaced apart by a front wall and a rear wall.

12. The cooking appliance of claim 11, wherein the at least one aperture includes a single aperture.

13. The cooking appliance of claim 12, wherein the inner wall defining the single aperture includes an entry section extending from a lower body surface of the nozzle body and an exit section angled from the entry section and that extends from the entry section to an upper surface of the nozzle body.

14. The cooking appliance of claim 12, wherein the single aperture extends between the rear wall and the front wall to define a thickness and the thickness is reduced near an upper surface of the nozzle body.

15. The cooking appliance of claim 14, wherein the nozzle apparatus defines an empty space that is spaced from the single aperture by at least one post that is insertable into holes on the cooktop, wherein the material having elastic memory permits flexing of the nozzle apparatus without changing the thickness of the single aperture.

16. An electric cooking appliance comprising:

an outer frame surface defining a cooktop, wherein the cooktop defines an outlet port;

an inner frame surface defining a heating cavity disposed below the cooktop and within the outer frame surface, wherein the inner frame surface defines an inlet port;

a chimney extending between a first end connected to the inlet port and a second end connected to the outlet port for directing steam from the heating cavity outside of the cooking appliance;

a cover having a closed position wherein the cover substantially overlaps the cooktop, and an open position wherein the cover is pivoted at an angle from the cooktop; and a nozzle apparatus formed of a material having elastic memory is connected and sealing engaged around the outlet port via deformation, the nozzle apparatus further coupled to the outlet port via a snap-fit connection and including an inner wall defining at least one aperture, wherein the at least one aperture is oriented at an angle substantially centrally between the cooktop and the cover in the open position to prevent condensation on the cover.

17. The electric cooking appliance of claim 16, wherein the cover includes a bottom edge, and a slot spaced from the bottom edge that is substantially aligned with the angle of the at least one aperture.

18. A gas cooking appliance comprising:

an outer frame surface defining a cooktop, wherein the cooktop defines an outlet port near a rear surface of the cooktop;

an inner frame surface defining a heating cavity disposed below the cooktop and within the outer frame surface, wherein the inner frame surface defines an inlet port;

a chimney extending between a first end connected to the inlet port and a second end connected to the outlet port for directing steam from the heating cavity outside of the cooking appliance;

a rear console with internal electric components and extending from the rear surface of the cooktop at an angle from the cooktop; and a nozzle apparatus connected around the outlet port and including an inner wall defining at least one aperture, wherein the at least one aperture is oriented at an angle substantially centrally between a front edge of the cooktop and the rear console to prevent steam exiting the at least one aperture from contacting the rear console and heating the internal electric components.

19. The gas cooking appliance of claim 18, further comprising:

a plurality of several grates;

one of the several grates defining a port opening; and the nozzle apparatus aligned with the port opening.

* * * * *